United States Patent [19]

Hähnle et al.

[11] 4,422,854

[45] Dec. 27, 1983

[54] TRANSFER PRINTING SUPPORT, PROCESS FOR THE MANUFACTURE THEREOF, WITH BLUE AZO DYE:DI-CYANO-NITRO-PHENYL-AZO ANILINE

[75] Inventors: Reinhard Hähnle, Königstein; Manfred Schneider, Eppstein; Claus Schuster, Hofheim am Taunus; Rudolf Schickfluss, Kelkheim, all of Fed. Rep. of Germany

[73] Assignee: Hoechst Aktiengesellschaft, Frankfurt am Main, Fed. Rep. of Germany

[21] Appl. No.: 383,732

[22] Filed: Jun. 1, 1982

[30] Foreign Application Priority Data

Jun. 3, 1981 [DE] Fed. Rep. of Germany ..... 3121981

[51] Int. Cl.[3] ..... B41M 5/02; D06P 5/00

[52] U.S. Cl. ..... 8/471; 8/662; 8/532; 8/922; 106/22; 427/148

[58] Field of Search ..... 8/471, 662

[56] References Cited

U.S. PATENT DOCUMENTS

| | | | |
|---|---|---|---|
| 4,105,655 | 8/1978 | Gottschlich et al. | 260/207.1 |
| 4,185,957 | 1/1980 | Magill | 8/467 |
| 4,212,642 | 7/1980 | Della Casa et al. | 8/470 |

FOREIGN PATENT DOCUMENTS

| | | |
|---|---|---|
| 25903 | 4/1981 | European Pat. Off. . |
| 45479 | 2/1982 | European Pat. Off. . |
| 1809920 | 6/1970 | Fed. Rep. of Germany . |
| 1184825 | 3/1970 | United Kingdom . |
| 1385934 | 3/1975 | United Kingdom . |
| 2028361 | 3/1980 | United Kingdom . |

OTHER PUBLICATIONS

Vewkataraman's "The Chemistry of Synthetic Dyes", vol. VIII (Academic Press, 1978), pp. 192–193.

*Primary Examiner*—A. Lionel Clingman
*Attorney, Agent, or Firm*—Curtis, Morris & Safford

[57] ABSTRACT

Transfer printing supports impregnated or printed with a formulation containing a dyestuff of the formula I

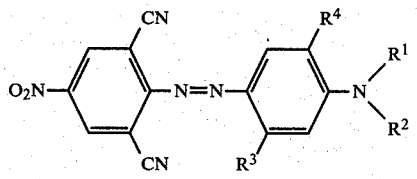

(I).

in which $R^1$ is alkyl having from 1 to 4 carbon atoms, $R^2$ is hydrogen or has the meaning of $R^1$, $R^3$ is methyl, methoxy or ethoxy, and $R^4$ is hydrogen, methyl, methoxy or ethoxy, or containing mixtures of such dyestuffs, a process for the manufacture of these supports, which comprises impregnating or printing the support material with formulations containing a dyestuff of the formula I or mixtures of such dyestuffs, and the use of these supports for the dyeing and printing of flat web or sheet structures of synthetic or natural materials according to the heat transfer printing process.

9 Claims, No Drawings

TRANSFER PRINTING SUPPORT, PROCESS FOR THE MANUFACTURE THEREOF, WITH BLUE AZO DYE:DI-CYANO-NITRO-PHENYL-AZO ANILINE

The invention relates to transfer printing supports impregnated or printed with a formulation containing a dyestuff of the formula I

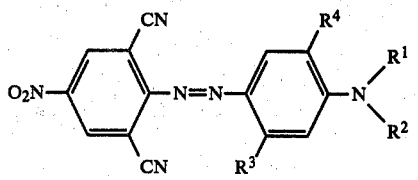

(I)

in which $R^1$ is alkyl having from 1 to 4 carbon atoms, $R^2$ is hydrogen or has the meaning of $R^1$, $R^3$ is methyl, methoxy or ethoxy, and $R^4$ is hydrogen, methyl, methoxy or ethoxy, or containing mixtures of such dyestuffs.

Preferred transfer printing supports of the invention are impregnated or printed with formulations containing dyestuffs of the formula I in which $R^1$ and $R^2$ each are alkyl having from 1 to 4 carbon atoms, $R^3$ is methyl, and $R^4$ is hydrogen, or mixtures of such dyestuffs.

The invention relates furthermore to a process for the manufacture of these supports, which comprises impregnating or printing the support material with formulations containing a dyestuff of the formula I or mixtures of such dyestuffs.

The invention relates furthermore to the use of these supports for the dyeing and printing of flat web or sheet structures according to the heat transfer printing process. Preferably, these structures consist of synthetic or partially synthetic polymer materials or materials treated with such synthetic or partially synthetic polymer materials. The flat structures may alternatively consist of or contain natural fiber materials, with the proviso, however, that they are treated with formulations which impart an affinity for the dyestuffs of the formula I to these natural materials.

The dyestuffs of the formula I are state of the art and obtainable according to the methods usual for this azo dyestuff type.

The azo dyestuffs of the formula I used for this invention are prepared by subjecting azo dyestuffs of the formula II

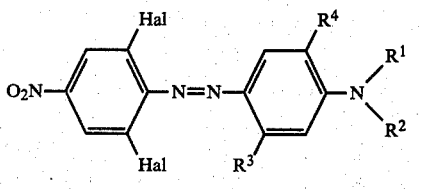

(II)

in which $R^1$ through $R^4$ are as defined above and Hal is chlorine or bromine, in known manner, for example according to the indications of German Offenlegungsschriften Nos. 1,809,920 or 1,809,921, or British Pat. No. 1,184,825, to a nucleophilic exchange reaction, using the cyanide ion as nucleophilic agent. Further processes for preparing the dyestuffs of the formula I are for example described in German Offenlegungsschrift No. 2,834,386 and U.S. Pat. No. 4,105,655.

The dyestuffs to be used in accordance with the invention not only exhibit outstanding transfer properties, but also give prints having excellent depth of color and sharply outlined pattern. They are therefore suitable for a combination with other transfer printing dyestuffs with the proviso that under the prevailing conditions all dyestuffs have substantially similar transfer properties.

The dyestuffs of the formula I have a good fastness to light, and their tinctorial strength is superior to that of the blue anthraquinone dyestuffs used in transfer printing.

The dyestuffs of the formula I have furthermore the advantage of yielding easily pourable printing inks having a low electrolyte and dispersing agent content and a high dyestuff concentration, which because of the required thin layer of printing paste on paper are in great demand.

Suitable support materials for the transfer-printing supports according to the invention are, as is known, all flat sheet-like structures which are inert towards the dyestuff applied and do not impede sublimation. Possible supports are flat sheet and web structures of metal, such as aluminum sheet, or of natural or regenerated cellulose materials, such as woven or knitted fabrics or, preferably, paper webs.

The fomulations which contain the dyestuffs of the formula I and with which the support materials are impregnated or printed can be aqueous printing pastes, such as are customary in textile printing, or organic printing inks, such as are used in graphic printing.

Aqueous printing pastes contain the customary natural or synthetic thickeners, for example polyvinylalcohols, methylcellulose, or polymerization products containing carboxy groups, for example polyacrylates.

The composition of the organic printing inks depends on the nature of the substrate, of the support material, of the printing process and of the equipment available. In general, such printing inks consist of one or more of the dyestuffs of the formula I, a binder, one or more dispersing agents and, if appropriate, a solvent, fillers and preservatives.

Suitable binders are natural, semi-synthetic and synthetic resins, that is to say polymerization, polycondensation and polyaddition products. Examples of suitable resins which may be mentioned are: colophony and its derivatives, maleate resins, oil-free alkyd resins, alkyd resins of synthetic and natural fatty acids and arylated alkyd resins. Terpene resins, polyvinyl resins, such as polyvinyl acetate and polyvinyl chloride, copolymers and graft polymers with various vinyl monomers, acrylate resins, naphthalene/formaldehyde resins, ketone resins, silicone resins and cellulose derivatives, such as cellulose esters, for example nitrocellulose, or cellulose acetate, and cellulose ethers, such as, for example, methylcellulose, and other derivatives of other polysaccharides are also suitable.

Non-ionic or anionic products are preferably used as dispersing agents. Examples of non-ionic products which may be mentioned are: addition products of about 5 to 100 mols of alkylene oxide and higher fatty acids, fatty alcohol polyglycol ethers, phenol- or alkylphenol polyglycol ethers, and also oxalkylates of fatty acids esterified with polyols or of resin derivatives, such as hydroabietyl alcohol. Suitable anionic dispersing agents are: naphthalenesulfonic acid/formaldehyde condensates, lignin-sulfonates and sulfite waste liquor products.

The nature of the solvents depends on the type of printing process. Esters, ketones or alcohols, for example butyl acetate, acetone, methylethylketone, ethanol, isopropanol or butanol, are particularly preferred.

The printing pastes can be used for printing by all the customary printing processes, that is to say relief printing, planographic printing, gravure printing or screen printing. Printing processes which are particularly suitable for the production of printed auxiliary paper supports are gravure printing and rotary screen printing.

Suitable substrates are flat web and sheet structures such as non-wovens, felts, pelts, carpets, sheets and, above all, woven and knitted fabrics of synthetic or semi-synthetic materials, in particular of aromatic polyesters, such as polyethyleneglycol terephthalate, or cellulose acetates, such as cellulose triacetate and cellulose 2½-acetate, or polyamides. These synthetic or semi-synthetic materials exhibit an affinity for the dyestuffs of the formula I. However, it is also possible for substrates which in themselves have no affinity for these dyestuffs to be dyed and printed by the heat transfer-printing process by treating such substrates with the synthetic or semi-synthetic materials mentioned, for example, by covering them with an appropriate coating of such plastics. It is also possible to treat natural fiber materials which display no affinity for the dyestuffs of the formula I with suitable preparations and thus to provide these substances with an affinity for these dyestuffs. Appropriate processes are known, for example, from German Pat. No. 2,551,410, German Auslegeschrift No. 2,436,783 or German Offenlegungsschrift No. 2,045,465.

The heat transfer-printing process is generally known, and is described in detail, for example, in French Pat. Nos. 1,223,330, 1,334,829 and 1,585,119. In this process, the auxiliary supports, which are impregnated or printed with suitable formulations are brought into close contact with the substrate to be dyed or printed, after which the dyestuff is transferred from the support onto the substrate and fixed there under the action of heat and optionally reduced or elevated pressure.

When the dyestuffs of the formula I are used according to the invention, reddish to greenish-blue dyeings and prints having good performance fastnesses are obtained on the substrates.

The following Examples illustrate the invention, parts and percentages being by weight unless otherwise stated.

EXAMPLE 1

300 Parts of the dried dyestuffs of the following structure

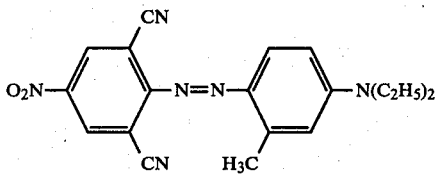

are homogenized in a dissolver with vigorous stirring with 84 parts of a nonionic dispersing agent (diacetic acid ester of a propylene/ethylene oxide block polymer having an average molecular weight of 8,500 and an ethylene oxide amount of 80%) and 40 parts of an anionic dispersing agent (sulfosuccinic acid semiester of an ethoxylated condensation product of nonylphenol and formaldehyde), 180 parts of ethyleneglycol, 300 parts of water and 5 parts of chloracetamide as preserving agent. The about 33% dyestuff mixture is introduced into a bead mill and ground there with siliquartzite beads and water cooling. After 4 hours a dispersion is obtained 90% of the particles of which are smaller than 3 microns. Water is then added until 1,000 parts of dispersion are obtained, and the dispersion is separated from the beads.

The formulation containing 30% of dyestuff is stable to storage at 50° C. as well as at room temperature, and it can be mixed by stirring and homogenized with a conventional printing thickener on the basis of alginate as well as with a synthetic thickener on the basis of polyacrylic acid. The viscosity of the synthetic printing thickener is influenced by the formulation to an insignificant extent only, so that printing with shallow engravings according to usual printing processes is possible. Transfer printing paper sheets printed with the printing ink give after the transfer onto polyester (about 25 seconds at 200° C.) a full, blue print. Similarly good results are obtained in transfer onto polyester/cotton (80:20).

EXAMPLE 2

350 Parts of the dried dyestuff of the following structure

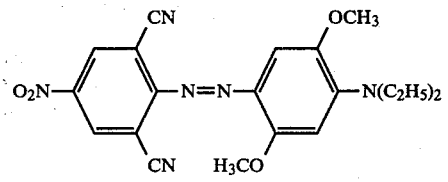

are homogenized with vigorous stirring in a dissolver with 100 parts of a nonionic dispersing agent (acetic acid ester of an ethoxylated nonylphenol, molecular weight 4,700, ethylene oxide amount 94%) and 26 parts of an anionic dispersing agent (neutralized di-methylnaphthalene-methanesulfonate), 180 parts of ethyleneglycol, 300 parts of water and 5 parts of chloracetamide as preserving agent.

The mixture containing about 36.4% dyestuff is introduced into a bead mill and ground there with siliquartzite beads and water cooling. After 5 hours, a dispersion is obtained 90% of the particles of which are smaller than 3 microns. Water is added until 1,000 parts of dispersion are obtained, and the dispersion is then separated from the beads. The formulation containing 35% of dyestuff is stable to storage at 50° C. as well as at room temperature, and it can be mixed by stirring and homogenized with a conventional printing thickener on the basis of alginate as well as with a synthetic thickener on the basis of polyacrylic acid.

Transfer printing paper sheets printed with the printing ink after the transfer onto polyester (about 25 seconds at 200° C.) give a full, greenish-blue print. In a similarly good manner, polyester/cotton materials (80:20) can be printed.

EXAMPLE 3

150 Parts each of the dried dyestuffs as described in Examples 1 and 2 are ground in a bead mill with siliquartzite beads together with 80 parts of a nonionic dispersing agent (reaction product of glycerol with castor oil fatty acid, reacted with 100 mols of ethylene oxide), and 25 parts of ligninsulfonate, 150 parts of ethyleneglycol, 200 parts of water and 5 parts of chloracetamide as preserving agent. After 7 hours a dispersion is obtained 90% of the particles of which are smaller than 3 microns. The formulation is made up with water to give 1,000 parts and separated from the beads.

The formulation containing 30% of dyestuff is stable to storage at room temperature and at 50° C. It can be mixed by stirring with a conventional printing thickener (alginate basis) as well as with a synthetic thickener (polyacrylic acid basis), and can be printed according to usual printing processes. After the transfer onto polyester (about 25 seconds at 200° C.), transfer printing paper sheets printed with this printing ink give a full, blue print. On polyester/cotton (80:20), a full, blue print is likewise obtained.

In the following Table, further dyestuffs of the formula I are listed as well as the shades obtainable according to the process indicated in Example 1. Instead of the individual pure dyestuffs, mixtures thereof may also be used.

| Example | $R^1$ | $R^2$ | $R^3$ | $R^4$ | Shade |
|---|---|---|---|---|---|
| 4 | n-$C_3H_7$ | n-$C_3H_7$ | $CH_3$ | H | blue |
| 5 | $C_2H_5$ | $C_2H_5$ | $OC_2H_5$ | H | " |
| 6 | $CH(CH_3)_2$ | H | $OCH_3$ | $OCH_3$ | greenish blue |
| 7 | $C_2H_5$ | $C_2H_5$ | $OCH_3$ | H | blue |
| 8 | $CH(CH_3)C_2H_5$ | H | $CH_3$ | H | " |
| 9 | n-$C_4H_9$ | H | $OC_2H_5$ | $OC_2H_5$ | greenish blue |
| 10 | n-$C_4H_9$ | n-$C_4H_9$ | $CH_3$ | H | blue |
| 11 | $CH_3$ | $CH_3$ | $OC_2H_5$ | H | blue |
| 12 | n-$C_3H_7$ | n-$C_3H_7$ | $OCH_3$ | $OCH_3$ | greenish blue |
| 13 | $CH(CH_3)_2$ | H | $CH_3$ | H | blue |
| 14 | $C(CH_3)_3$ | H | $CH_3$ | H | blue |
| 15 | $CH_3$ | $CH_3$ | $CH_3$ | H | blue |
| 16 | n-$C_4H_9$ | $C_2H_5$ | $CH_3$ | H | blue |
| 17 | n-$C_3H_7$ | $C_2H_7$ | $CH_3$ | H | blue |
| 18 | $C_2H_5$ | $C_2H_5$ | $CH_3$ | $CH_3$ | blue |
| 19 | $C_2H_5$ | $C_2H_5$ | $CH_3$ | $OCH_3$ | blue |

What is claimed is:

1. A transfer printing support, impregnated or printed with a formulation containing the dyestuff of the formula

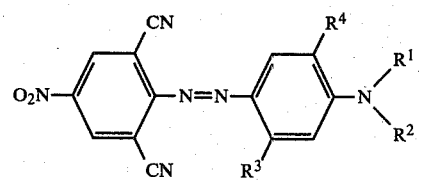

in which $R^1$ is alkyl of from 1 to 4 carbon atoms, $R^2$ is hydrogen or alkyl of from 1 to 4 carbon atoms, $R^3$ is methyl, methoxy or ethoxy, and $R^4$ is hydrogen, methyl, methoxy or ethyoxy, or containing a mixture of dyestuffs of said formula.

2. A support as claimed in claim 1, impregnated or printed with a formulation containing a dyestuff of said formula in which $R^1$ and $R^2$ each is alkyl of from 1 to 4 carbon atoms, or containing a mixture of dyestuffs of said formula.

3. A support as claimed in claim 1 or 2, impregnated or printed with a formulation containing a dyestuff of said formula in which $R^3$ is methyl, or containing a mixture of dyestuffs of said formula.

4. A support as claimed in claim 1 or 2, impregnated or printed with a formulation containing a dyestuff of said formula in which $R^4$ is hydrogen, or containing a mixture of dyestuffs of said formula.

5. A process for the manufacture of a support as claimed in claim 1 or 2, which comprises impregnating or printing the support material with a formulation containing a dyestuff of said formula or a mixture of dyestuffs of said formula.

6. A method of dyeing or printing a flat web or sheet structure, which comprises heat-transferring a dyestuff of the formula recited in claim 1 from a support as claimed in claim 1 to the flat web or sheet structure.

7. A method as claimed in claim 6, which comprises heat-transferring said dyestuff to the flat web or sheet structure treated with a synthetic or partially synthetic polymer material.

8. A method as claimed in claim 6, wherein the flat web or sheet structure consists of a synthetic or partially synthetic polymer material.

9. A method as claimed in claim 6, wherein said flat web or sheet structure consists of or contains natural fiber material treated with a formulation imparting an affinity for a dyestuff of said formula.

* * * * *